US009523187B2

(12) United States Patent
Rempert et al.

(10) Patent No.: US 9,523,187 B2
(45) Date of Patent: Dec. 20, 2016

(54) DECKING ASSEMBLY

(71) Applicant: Caterpillar Inc., Peoria, IL (US)

(72) Inventors: Carl Halder Rempert, Dunlap, IL (US); Kevin L. Martin, Washburn, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 15/139,046

(22) Filed: Apr. 26, 2016

(65) Prior Publication Data

US 2016/0237673 A1 Aug. 18, 2016

(51) Int. Cl.

| | |
|---|---|
| ***E04F 15/08*** | (2006.01) |
| ***E04B 1/00*** | (2006.01) |
| ***E04B 1/30*** | (2006.01) |
| ***E04B 5/02*** | (2006.01) |
| ***E04B 5/04*** | (2006.01) |
| ***E04B 5/06*** | (2006.01) |

(52) U.S. Cl.

CPC ..... *E04B 1/003* (2013.01); *E04B 1/30* (2013.01); *E04B 5/02* (2013.01); *E04B 5/04* (2013.01); *E04B 5/06* (2013.01)

(58) Field of Classification Search

CPC ..... E04B 1/30; E04B 1/003; E04B 5/02; E04B 5/04; E04B 5/06; E04B 2002/7475; E04D 3/3605; E04F 15/04; E04F 15/20; E04F 15/02038; E04F 15/02044; E04F 15/02133

USPC ..... 52/480, 483.1, 489.1, 489.2, 650.3

See application file for complete search history.

(56) References Cited

U.S. PATENT DOCUMENTS

| | | | | |
|---|---|---|---|---|
| 1,863,257 | A | 6/1932 | Tashjian | |
| 3,197,933 | A | 8/1965 | Burns et al. | |
| 4,453,349 | A | 6/1984 | Ryan | |
| 5,540,029 | A | 7/1996 | Elias | |
| 5,836,254 | A | 11/1998 | Johansson | |
| 6,314,699 | B1 * | 11/2001 | West | E04B 5/023 52/177 |
| 7,121,059 | B2 * | 10/2006 | Pervan | E04F 15/04 52/403.1 |
| 8,112,958 | B2 * | 2/2012 | Garcia | B32B 3/30 52/314 |
| 8,161,690 | B1 * | 4/2012 | Borne | E04B 5/12 404/35 |
| 2008/0099122 | A1 | 5/2008 | Andersen et al. | |
| 2015/0233124 | A1 | 8/2015 | Carrubba | |

FOREIGN PATENT DOCUMENTS

| | | |
|---|---|---|
| AU | 2013201787 | 5/2014 |
| AU | 2010347711 | 10/2015 |
| EP | 939174 | 9/1999 |

* cited by examiner

*Primary Examiner* — James Buckle, Jr.

(57) ABSTRACT

A decking assembly is provided. The decking assembly includes a pair of support joists and a plurality of planks made from a cementitious composite. Each of the plurality of planks includes a first lip portion and a second lip portion. The second lip portion is mutually opposite the first lip portion. A protruding portion of the each of the plurality of planks is configured to be received into a recess defined on one of the pair of support joists at a first end and on the other of the pair of support joists at a second end of the each of the plurality of planks. A locking panel is configured to interconnect with the second lip portion of one of the plurality of planks. One or more fastening means are defined on a first end and a second end of the locking panel.

1 Claim, 2 Drawing Sheets

DECKING ASSEMBLY

TECHNICAL FIELD

The present disclosure relates to a decking assembly. More particularly, the present disclosure relates to the decking assembly having an interlocking feature.

BACKGROUND

Decking assemblies generally include horizontal floors raised above ground. The decking assemblies may be attached adjacent to residential and commercial buildings as a walkway system. Other uses for the decking assemblies are boardwalks, boat docks, stairs, benches, and bridges.

The decking assemblies are generally made of wood. However, such decking assemblies require high maintenance and wood replacement, leading to laborious and costly solutions. Other decking assemblies make use of plastic or polymer boards. However, the plastic and polymer boards may be more susceptible to variations in temperatures.

U.S. Pat. No. 4,453,349 describes a structural deck especially suited for floors and roofs. The deck comprises an undulating metal structure having substantially horizontal bottom walls and top walls interconnected by downwardly and outwardly tapered, substantially flat side walls. Dove-tailed flanges are provided on the top portions of the side walls to interlock with concrete poured above. The inner surfaces of the dove-tailed flanges serve as supports for accessories, such as insulation, lighting fixtures and the like. The bottom portions of the side walls have outwardly extending dove-tailed flanges serving as supports for readily detachable closure caps having varying shapes, especially for aesthetic purposes.

However, known decking assemblies may have compromised structural integrity and difficulty in assembly. Hence, there is a need for an improved decking assembly design.

SUMMARY OF THE DISCLOSURE

In one aspect of the present disclosure, a decking assembly is provided. The decking assembly includes a pair of support joists made from a cementitious composite. Each of the pair of support joists includes a plurality of projected sections spaced part from one another along a first axis and defining a recess between each of the plurality of projected sections. The decking assembly includes a plurality of planks, each of the plurality of planks made from a cementitious composite. Each of the plurality of planks includes a first lip portion defined between a first surface and a second surface of the each of the plurality of planks. Further, a second lip portion is defined between the first surface and the second surface of the each of the plurality of planks. The second lip portion is mutually opposite to the first lip portion. The second lip portion is configured to interconnect with the first lip portion of an associated plank. A protruding portion is defined on the first surface and extending along a direction parallel to the first axis. The protruding portion is configured to be received into the recess defined on one of the pair of support joists at a first end of the each of the plurality of planks, and also configured to be received into the recess defined on the other of the pair of support joists at a second end of the each of the plurality of planks. A locking panel includes at least one extension member defined between a first surface and a second surface of the locking panel. The at least one extension member is configured to interconnect with the second lip portion of at least one of the plurality of planks along a second axis. The second axis is perpendicular to the first axis. One or more fastening means are defined on a first end and a second end of the locking panel. The one or more fastening means are configured to fasten the plurality of planks to the pair of support joists.

Other features and aspects of this disclosure will be apparent from the following description and the accompanying drawings.

DETAILED DESCRIPTION

Figure 1:
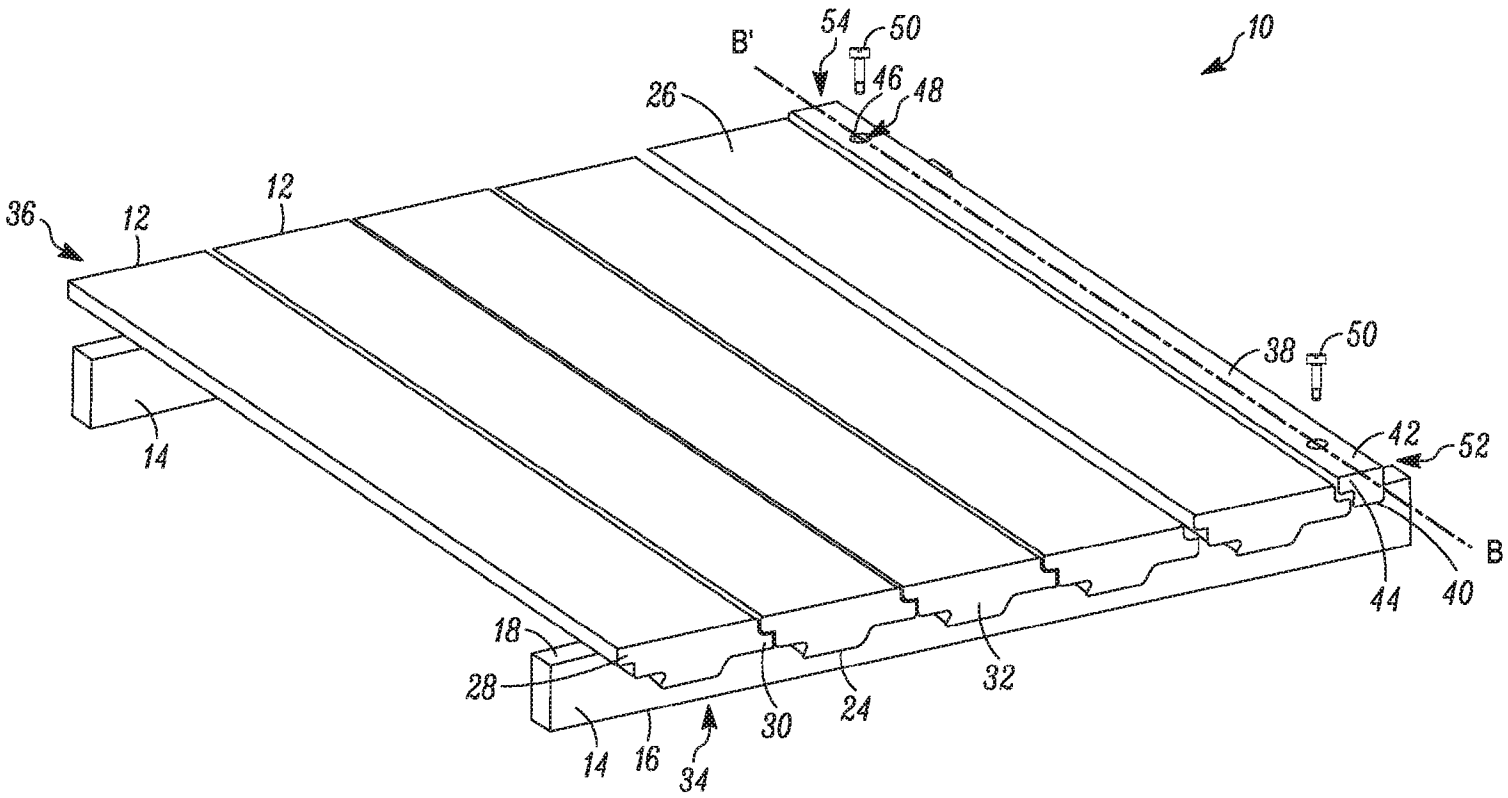
FIG. 1 is a perspective view of a decking assembly, according to one embodiment of the present disclosure.

Wherever possible, the same reference numbers will be used throughout the drawings to refer to same or like parts. Referring to FIG. 1, an exemplary decking assembly 10 is illustrated, The decking assembly 10 may for example, be used as a residential patio deck, a boardwalk, a boat dock, stairs, a bench or a bridge. Alternatively, the decking assembly 10 may be used for other purposes without any limitation.

Figure 2:
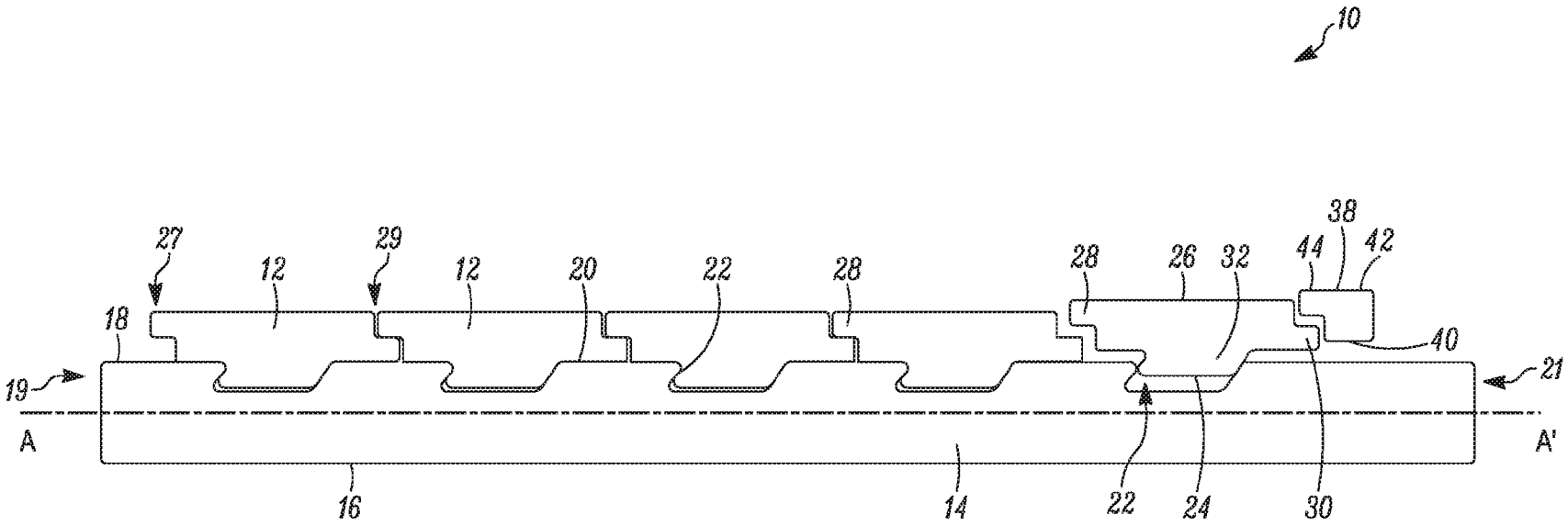
FIG. 2 is a side view of the decking assembly of FIG. 1, according to one embodiment of the present disclosure.

Referring to FIGS. 1 and 2, the decking assembly 10 includes a number of planks 12 removably affixed to a pair of support joists 14. The planks 12 and/or the support joists 14 are made of a cementitious composite. More specifically, the planks 12 and/or the support joists 14 are made of CEMPOSIT materials or macro-defect-free cement. The CEMPOSIT materials are a class of cementitious composites that are processed similar to rubber and result in a rigid product that is competitive in terms of strength and cost compared to certain metals, wood, and plastics. In one embodiment, the planks 12 and/or the support joists 14 may be clad with a sheet molding compound on multiple surfaces thereof.

Each of the support joists 14 has a substantially rectangular and planar configuration. The support joists 14 are placed on a reference or ground surface (not shown) to raise the decking assembly 10 above the reference surface. The support joist 14 includes a first surface 16. The first surface 16 is configured to be coupled to the reference surface. The support joist 14 may be coupled to the reference surface by any known fastening means such as, adhesion, welding, bolting, and so on. Although the accompanying figures illustrate two support joists 14, the number of the support joists 14 and dimensions thereof may vary based on the application.

Referring to FIG. 2, the support joist 14 also includes a second surface 18. The second surface 18 is mutually opposite to the first surface 16. The second surface 18 includes a number of projected sections 20. The projected sections 20 are spaced apart along a first axis A-A' from one end 19 of the support joist 14 to another end 21. Each of the projected sections 20 is spaced apart from one another in a manner such that a recess 22 is defined between adjacent projected sections 20.

Referring to FIGS. 1 and 2, the plank 12 is configured to be removably attached to the support joist 14, The plank 12 includes a first surface 24 and a second surface 26. The plank 12 includes a first lip portion 28 defined between the first surface 24 and the second surface 26. The first lip portion 28 is defined along one end 27 of the plank 12 and is configured to interconnect with a second lip portion 30 of an adjacent plank 12.

The second lip portion 30 of the plank 12 is defined between the first surface 24 and the second surface 26 of the plank 12. More specifically, the second lip portion 30 is defined along another end 29 of the plank 12 and is mutually opposite to the first lip portion 28. The second lip portion 30 is configured to interconnect with the first lip portion 28 of the adjacent plank 12.

The plank 12 also includes a protruding portion 32. More specifically, the protruding portion 32 is parallel to the first lip portion 28 and the second lip portion 30 and extends in a direction perpendicular to the first axis A-A'. The protruding portion 32 is configured to be received into the recess 22 defined by the projected sections 20 of the support joists 14 (see FIG. 2). More specifically, the protruding portion 32 is received into the recess 22 of one of the support joists 14 at a first end 34 (see FIG. 1) of the plank 12 and is also received into the other of the support joists 14 at a second end 36 of the plank 12 (see FIG. 1).

Each of the planks 12 of the decking assembly 10 is assembled onto the support joists 14 in an adjacent manner. The protruding portion 32 of each of the planks 12 is received into the recess 22 of the pair of support joists 14. Also, the first lip portion 28 of each of the planks 12 is interlocked with the second lip portion 30 of the adjacent plank 12. Similarly, the second lip portion 30 of each of the planks 12 is interlocked with the first lip portion 28 of the adjacent plank 12. In the accompanying figures, five of the planks 12 are connected to each other to form the decking assembly 10. In other embodiments, the number and dimensions of the planks 12 may vary based on the application and is not limited to that described herein.

Additionally, the decking assembly 10 includes a locking panel 38. The locking panel 38 is configured to lock the planks 12 to the support joists 14. The locking panel 38 is made of a cementitious composite. More specifically, the locking panel 38 is made of CEMPOSIT materials or macro-defect-free cement. In one embodiment, the locking panel 38 may be clad with a sheet molding compound on multiple surfaces thereof.

The locking panel 38 includes a first surface 40 and a second surface 42. The locking panel 38 includes at least one extension member 44 defined between the first surface 40 and the second surface 42. The extension member 44 is configured to interconnect with the second lip portion 30 of the plank 12 (see FIG. 2) along a second axis B-B' (see FIG. 1), the second axis B-B' is perpendicular to the first axis A-A' (see FIG. 2). In one embodiment, the locking panel 38 may also include another extension member (not shown) defined between the first surface 40 and the second surface 42. This extension member may be mutually opposite to the extension member 44 and may interconnect with the first lip portion 28 of the adjacent plank 12. In other embodiments, the locking panel 38 may be placed at fixed intervals between the planks 12. For example, after every six of the planks 12, one locking panel (not shown) is positioned on the decking assembly 10. In this case, the locking panel will have two extension members extending therefrom.

Referring to FIG. 1, the locking panel 38 also includes one or more fastening means 46 defined on the second surface 42 of the locking panel 38. The fastening means 46 is configured to fasten the plank 12 to the support joist 14. More specifically, the fastening means 46 includes holes 48 defined through the second surface 42 and the first surface 40 of the locking panel 38. The holes 48 are configured to receive one or more fastening members 50 such as bolts, screws, straps, and so on to fasten the plank 12 to the support joist 14. In one embodiment, the fastening means 46 may be provided at a first end 52 and a second end 54 of the locking panel 38. In other embodiments, depending upon the application, the fastening means 46 may be positioned at various locations on the decking assembly 10.

In one embodiment, the planks 12, the support joists 14 and/or the locking panel 38 may be coated using a bulk molding compound, such as, glass-fiber reinforced thermoset polyester. In one example, the bulk molding compound may be applied to a boundary or perimeter of the plank 12, the support joists 14, and/or the locking panel 38. In another example, the bulk molding compound may be applied to the first surface 24 of the planks 12, the first surface 16 of the support joists 14 and/or the first surface 40 of the locking panel 38. In yet another example, the bulk molding compound may be applied to the second surface 26 of the planks 12, the second surface 18 of the support joists 14 and/or the second surface 42 of the locking panel 38. Alternatively, the bulk molding compound may be selectively applied to various locations on the planks 12, the support joists 14, and/or the locking panel 38.

INDUSTRIAL APPLICABILITY

The decking assembly 10 is structured to provide an interlocking feature wherein the adjacent planks 12 of the decking assembly 10 are connected to one another by the interlocking of the first lip portion 28 of one of the planks 12 with the second lip portion 30 of the adjacent plank 12. Further, the protruding portion 32 at the first surface 24 of the plank 12 allows for the interlocking of the plank 12 with each of the support joists 14. Further, the material properties of the cementitious composite used to form the planks 12 and the support joists 14 is such that the decking assembly 10 has an improved life. A weatherability of the decking assembly 10 is increased due to the material properties of the cementitious composite since the decking assembly 10 may be less susceptible to damage and wear and tear when subject to changes in weather conditions, such as heat and cold, and exposure to water.

Additionally, the geometry of the decking assembly 10 based on the interlocking design, and rigidity of the decking assembly 10 based on the material properties of the planks 12 and the support joists 14 is such that the decking assembly 10 may he easily assembled or disassembled. Hence, the decking assembly 10 may have a reduced assembly time and a simple installation process associated therewith. The interlocking design of the decking assembly 10 is such that the decking assembly 10 does not require the use of external fasteners that may otherwise contribute to easy and quick deterioration of the decking assembly 10. The components of the decking assembly 10, viz the planks 12, the support joists 14, and the locking panel 38 may be molded or extruded.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A decking assembly comprising:

a pair of support joists made from a cementitious composite, wherein each of the pair of support joists includes a plurality of projected sections spaced part from one another along a first axis and defining a recess between each of the plurality of projected sections;

a plurality of planks made from a cementitious composite, wherein the each of the plurality of planks including:

a first lip portion defined between a first surface and a second surface of the each of the plurality of planks;

a second lip portion defined between the first surface and the second surface of the each of the plurality of planks, wherein the second lip portion is mutually opposite to the first lip portion, wherein the second lip portion is configured to interconnect with the first lip portion of an associated plank;

a protruding portion defined on the first surface and extending along a direction perpendicular to the first axis, wherein the protruding portion is configured to be received into the recess defined on one of the pair of support joists at a first end of the each of the plurality of planks, and also configured to be received into the recess defined on the other of the pair of support joists at a second end of the each of the plurality of planks; and a locking panel including:

at least one extension member defined between a first surface and a second surface of the locking panel, wherein the at least one extension member is configured to interconnect with the second lip portion of at least one of the plurality of planks along a second axis, the second axis being perpendicular to the first axis; and one or more fastening means defined on a first end and a second end of the locking panel, the one or more fastening means configured to fasten the plurality of planks to the pair of support joists.

* * * * *